US009835398B2

(12) United States Patent
Biegel

(10) Patent No.: US 9,835,398 B2
(45) Date of Patent: Dec. 5, 2017

(54) FIREARM TRIGGER GROUP MODULE WITH PIVOTING ELEMENT NON-COAXIAL TO ASSEMBLY PIN AND METHOD OF INSTALLING A TRIGGER GROUP MODULE

(71) Applicant: CMC Triggers Corp., Fort Worth, TX (US)

(72) Inventor: Jack Richard Biegel, Arlington, TX (US)

(73) Assignee: CMC Triggers Corp., Fort Worth, TX (US)

( * ) Notice: Subject to any disclaimer, the term of this patent is extended or adjusted under 35 U.S.C. 154(b) by 43 days.

(21) Appl. No.: 15/071,300

(22) Filed: Mar. 16, 2016

(65) Prior Publication Data

US 2017/0138689 A1 May 18, 2017

Related U.S. Application Data

(60) Provisional application No. 62/255,768, filed on Nov. 16, 2015.

(51) Int. Cl.

| | |
|---|---|
| ***F41A 19/15*** | (2006.01) |
| ***F41A 19/10*** | (2006.01) |
| ***F41A 19/14*** | (2006.01) |
| ***F41A 3/66*** | (2006.01) |

(52) U.S. Cl.

CPC ..... *F41A 19/15* (2013.01); *F41A 3/66* (2013.01); *F41A 19/10* (2013.01); *F41A 19/14* (2013.01)

(58) Field of Classification Search

CPC ..... F41A 3/66; F41A 19/15; F41A 19/10

See application file for complete search history.

(56) References Cited

U.S. PATENT DOCUMENTS

| | | | | |
|---|---|---|---|---|
| 4,679,487 | A * | 7/1987 | Houseman | F41A 19/15 42/75.03 |
| 6,722,072 | B1 | 4/2004 | McCormick | |
| 6,772,548 | B1 | 8/2004 | Power | |
| 7,162,824 | B1 | 1/2007 | McCormick | |
| 7,293,385 | B2 | 11/2007 | McCormick | |
| 7,600,338 | B2 | 10/2009 | Geissele | |
| 8,220,193 | B1 * | 7/2012 | Lynch | F41A 17/48 42/70.08 |
| 9,046,313 | B1 * | 6/2015 | Lutton | F41A 17/46 |
| 9,146,067 | B2 | 9/2015 | Stakes | |
| 2009/0071053 | A1 * | 3/2009 | Thomele | F41A 11/02 42/1.01 |
| 2011/0185615 | A1 | 8/2011 | Gangl | |

* cited by examiner

*Primary Examiner* — Stephen Johnson

(74) *Attorney, Agent, or Firm* — Wood Herron & Evans LLP

(57) ABSTRACT

Provided is a trigger group module for a firearm that includes a portion defining a trigger group receiving area having laterally spaced apart walls with at least two pairs of laterally opposed openings for receiving assembly pins. The trigger group module includes a module frame sized to be inserted into the trigger group receiving area and has assembly pin receiving openings positioned to align with the laterally opposed openings in the walls of the trigger group receiving area. A hammer member is pivotally supported by the module frame along a first substantially transverse axis. A trigger member is supported by the module frame along a second substantially transverse axis. At least one of the first and second substantially transverse axes is not coaxially aligned with an assembly pin receiving opening.

28 Claims, 11 Drawing Sheets

FIREARM TRIGGER GROUP MODULE WITH PIVOTING ELEMENT NON-COAXIAL TO ASSEMBLY PIN AND METHOD OF INSTALLING A TRIGGER GROUP MODULE

RELATED APPLICATION

This application claims the benefit of and priority to U.S. Provisional Patent Application No. 62/255,768, filed Nov. 16, 2015.

FIELD OF THE INVENTION

This invention relates a so-called "drop-in" replacement trigger mechanism or module, particularly one to fit AK-pattern firearms. It provides a trigger mechanism mounted in a frame or housing independent of the firearm receiver in which at least one of the trigger and hammer does not pivot on an assembly pin extending through the receiver walls.

BACKGROUND OF THE INVENTION

AK-pattern firearms, while known for their simplicity and reliability, are not known for precision. As used herein, "AK-pattern" firearm is mean to include firearms of the Avtomat Kalashnikov or AK family, including the AK-47, AKM, AK-103, AK-74, AKS and others built on an AK type receiver, such as the Saiga family of rifles and shotguns. While simplicity of design and manufacturing are not mutually exclusive of precision, many owners of AK-pattern firearms made without precision often wish to upgrade certain features and aspects of the firearm with aftermarket products, parts, or accessories. A common "upgrade" is to install a new trigger mechanism, which generally includes a trigger member, disconnector, and hammer with associated springs and pivot pins.

In a standard or OEM (original equipment manufacturer) configuration, the hammer and trigger of an AK-pattern firearm are mounted to pivot on assembly pins that extend through openings in opposite side walls of the receiver. Most commonly, the receiver is formed from a flat sheet of metal that is stamped to form its finished shape. Openings in the receiver side walls that receive assembly pins may be punched or drilled in the sheet of metal prior to stamping. While it is intended that the finished location of these openings be precisely aligned with one another and provide axes of rotation transverse to the receiver and that are exactly parallel to one another, in practice, they may not be. The sometimes imprecise location of these openings makes it difficult to retrofit the firearm with a precision trigger mechanism.

Others have addressed this shortcoming by producing "drop-in" trigger or fire control modules that are held together as a unit by a frame or housing. However, because the final assembly pins that hold the module in place within the receiver extend through and form the axis of rotation for the trigger member and hammer, imprecision in the original receiver can result in distortion of the module causing misalignment of critical interfaces, such as the sear and/or disconnector to the hammer. Some manufacturers of these "drop-in" trigger mechanism units even expect such misalignment and instruct the installer to file or otherwise alter these critical interfaces to make the replacement trigger mechanism functional. While such custom fitting may be within the skill of a gunsmith, many end users who do their own customization by using a "drop-in" replacement trigger unit are not so skilled and expect the replacement mechanism to function properly and easily without modification of critical parts.

"Drop-in" replacement trigger modules designed for other types of firearms, such as the AR15, do not face these problems. The receivers of AR15-pattern firearms are generally milled with relative precision from a billet of material or a forging blank, not a stamped sheet. In addition to the relatively precise placement of openings for the assembly/pivot pins, the interior dimensions of the receiver's trigger group receiving area, including the transverse width between side walls, is typically held to close tolerances. The design of OEM parts for AR15-pattern firearms expect this level of precision, not commonly found in AK-pattern firearms, so the same can be expected from designers and manufacturers of "drop-in" replacement trigger modules for the AR15.

SUMMARY OF THE INVENTION

The present invention provides a "drop-in" replacement fire control system module, such as for a firearm that includes a portion defining a trigger group receiving area having laterally spaced apart walls with at least two pairs of laterally opposed openings for receiving assembly pins. The trigger group module comprises a module frame sized to be inserted into the trigger group receiving area and having assembly pin receiving openings positioned to align with the laterally opposed openings in the walls of the trigger group receiving area. A hammer member is pivotally supported by the module frame along a first substantially transverse axis. A trigger member is supported by the module frame along a second substantially transverse axis. At least one of the first and second substantially transverse axes is not coaxially aligned with an assembly pin receiving opening.

According to one aspect of the invention, the frame may include adjustment mechanisms, such as downwardly extendable set screws, to bear against the floor of the receiver or other parts mounted thereon. These adjustment mechanisms may be located longitudinally forward of the hammer pivot axis and/or rearward of the trigger pivot axis.

According to another aspect and method of the invention, a trigger/disconnector subassembly may be easily removed from and installed in the trigger unit's frame or housing. This allows the frame and attached hammer to be inserted into the firearm receiver without complete disassembly of the firearm followed by attachment of the trigger/disconnector subassembly after the frame has been partially or completely installed.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various figures of the drawing, wherein.

DETAILED DESCRIPTION OF THE INVENTION

Figure 1:
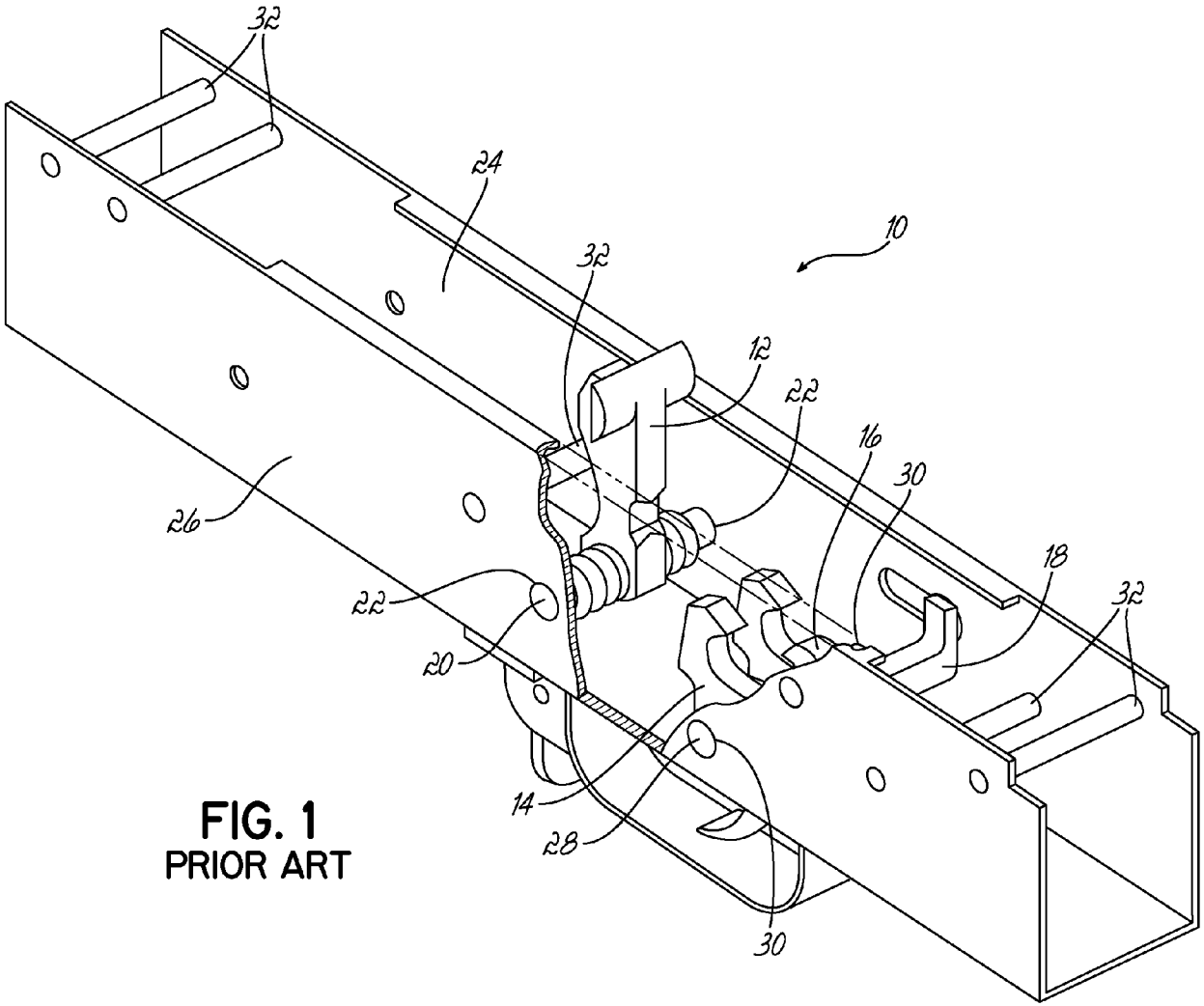
FIG. 1 PRIOR ART
FIG. 1 is a partially cut-away, isometric view of an AK-pattern receiver showing a prior art OEM trigger mechanism.
Figure 2:
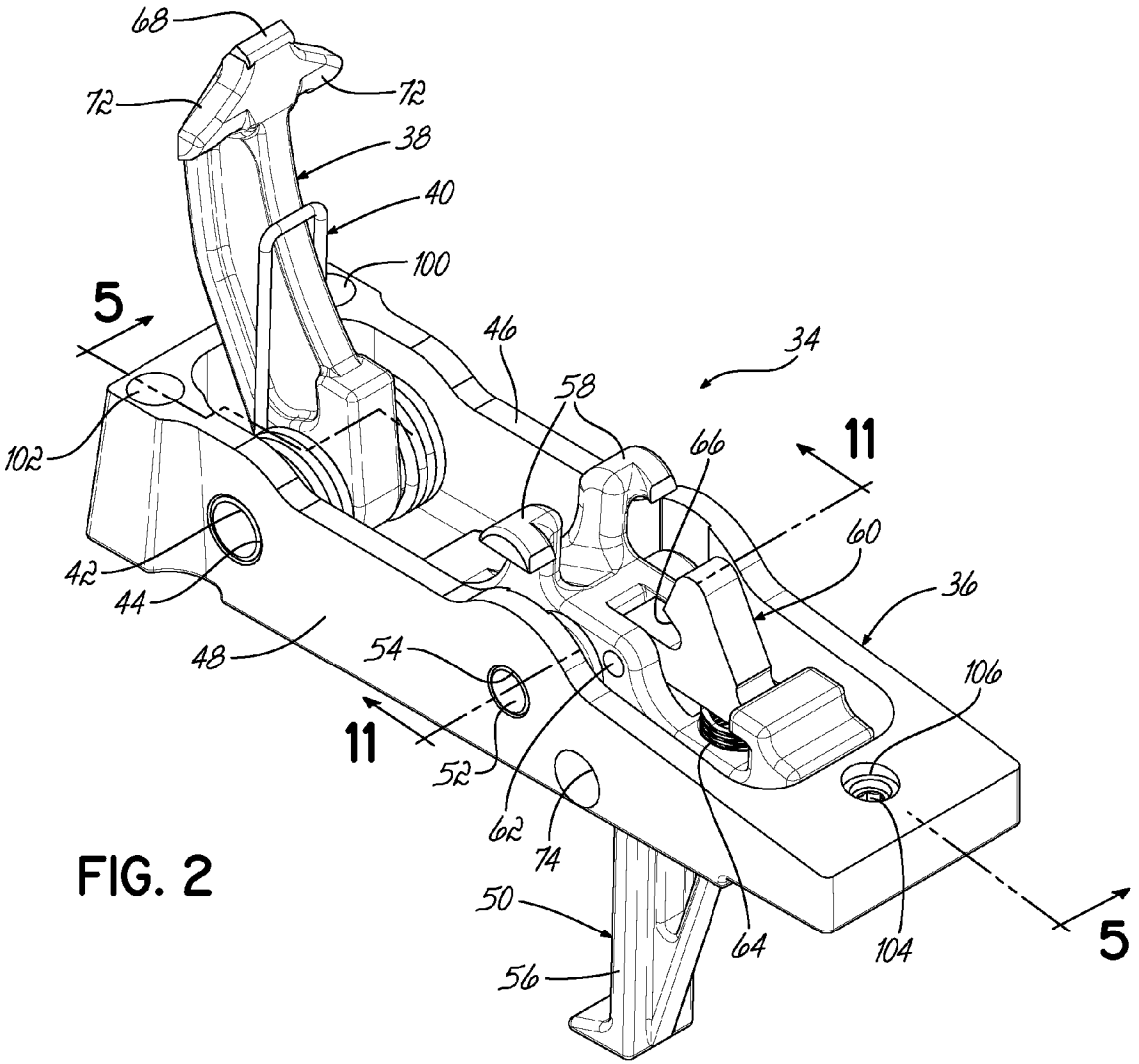
FIG. 2 is a isometric view of a replacement trigger unit according to one embodiment of the present invention showing the hammer in a fired or "dropped" position.
Figure 3:
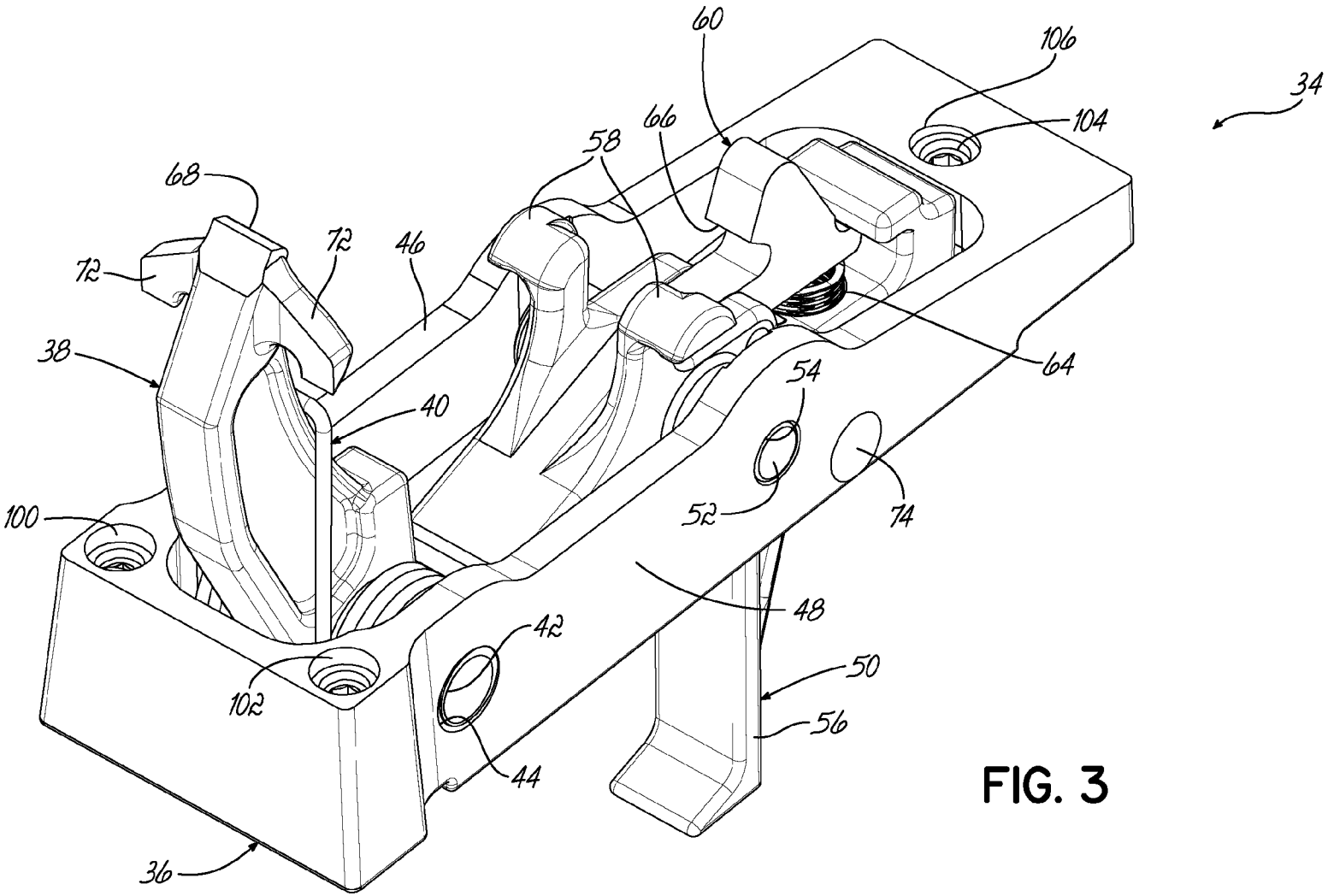
FIG. 3 is a forward isometric view of the unit shown in FIG. 2.
Figure 4:
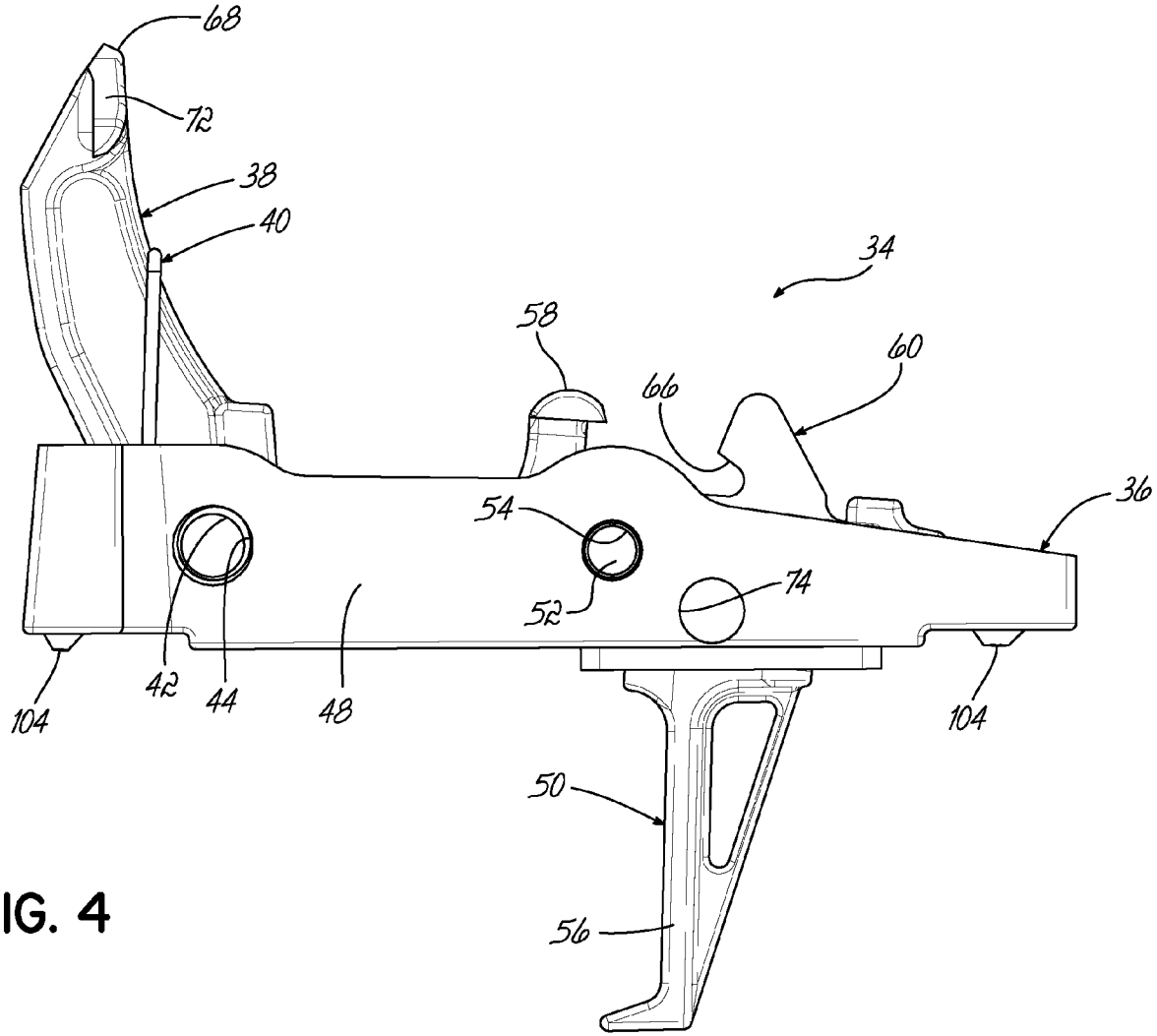
FIG. 4 is a left-side elevation view thereof.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Referring first to FIG. 1, therein is shown a partially cut-away receiver 10 of typical stamped metal construction with a typical OEM hammer 12, trigger member 14, disconnector 16, and safety member 18 installed therein. The hammer 12 is pivotally mounted on an assembly pin 20 that extends transversely through opposite openings 22 formed in right and left side walls 24, 26 of the receiver 10. Likewise, the trigger member 14 is pivotally mounted on an assembly pin 28 that extends transversely through opposite openings 30 in the side walls 24, 26 of the receiver 10. The disconnector 16 is mounted on the trigger member 14. Likewise, a safety member 18 may be pivotally secured between opposite side walls 24, 26 of the receiver body 10. Other assembly pins 32, which also extend transversely through opposite openings in the receiver 10, are illustrated for context, but have no significance to the present invention. All of the above described components are well known in prior art construction.

When a person, whether a gunsmith or an end user, wishes to replace the components of the trigger mechanism, the mounting pins 20, 28 are removed by driving them axially, such as with a punch, from their assembled position through the openings 22, 30 in the receiver 10. Thus, the hammer 12 (and related spring) and the trigger member/disconnector 14, 16 (and related springs) may be removed through the open top of the receiver 10.

Referring now to FIGS. 2-7, therein is shown at 34 a unitary fire control system or "drop-in" replacement trigger group module according to an embodiment of the present invention for an AK-pattern firearm. The unit 34 includes an open top housing or module frame 36 into which component parts of the fire control system are mounted. The unit 34 includes a hammer 38 and torsion hammer spring 40 which are mounted on a hollow sleeve 42 that extends transversely through opposite openings 44 formed in a forward portion of longitudinally extending side walls 46, 48 of the frame 36. The mounting sleeve 42 has an axial interior passage with a diameter sized to receive a mounting pin 20 (not shown in FIGS. 2-7) that will fit and extend through openings 22 in the receiver 10.

The unit 34 also includes a trigger member 50 that is pivotally mounted on a mounting pin 52 having ends that extend through opposite openings 54 in the side walls 46, 48 of the frame 36. The trigger member 50 includes a shoe or finger lever portion 56 that can be straight, curved, or formed in any desired configuration. The trigger member 50 also includes sear hook portions 58 which pivotally move with trigger member 50 in a direction opposite that of the finger lever portion 56, above the mounting pin 52. Also mounted on the trigger member 50 is a disconnector 60 which pivots in a limited range of motion on a pivot pin 62, separate and independent of the pivotal movement of the trigger member 50. A coil spring 64 biases the disconnector 60 toward a position at which its hook 66 can engage an end edge 68 of the hammer 38 when the hammer 38 is reset by cycling action of the firearm prior to release of the trigger member 50. The trigger member 50 is biased toward a release or reset position by a trigger spring 70 (shown in FIG. 5).

Figure 6:
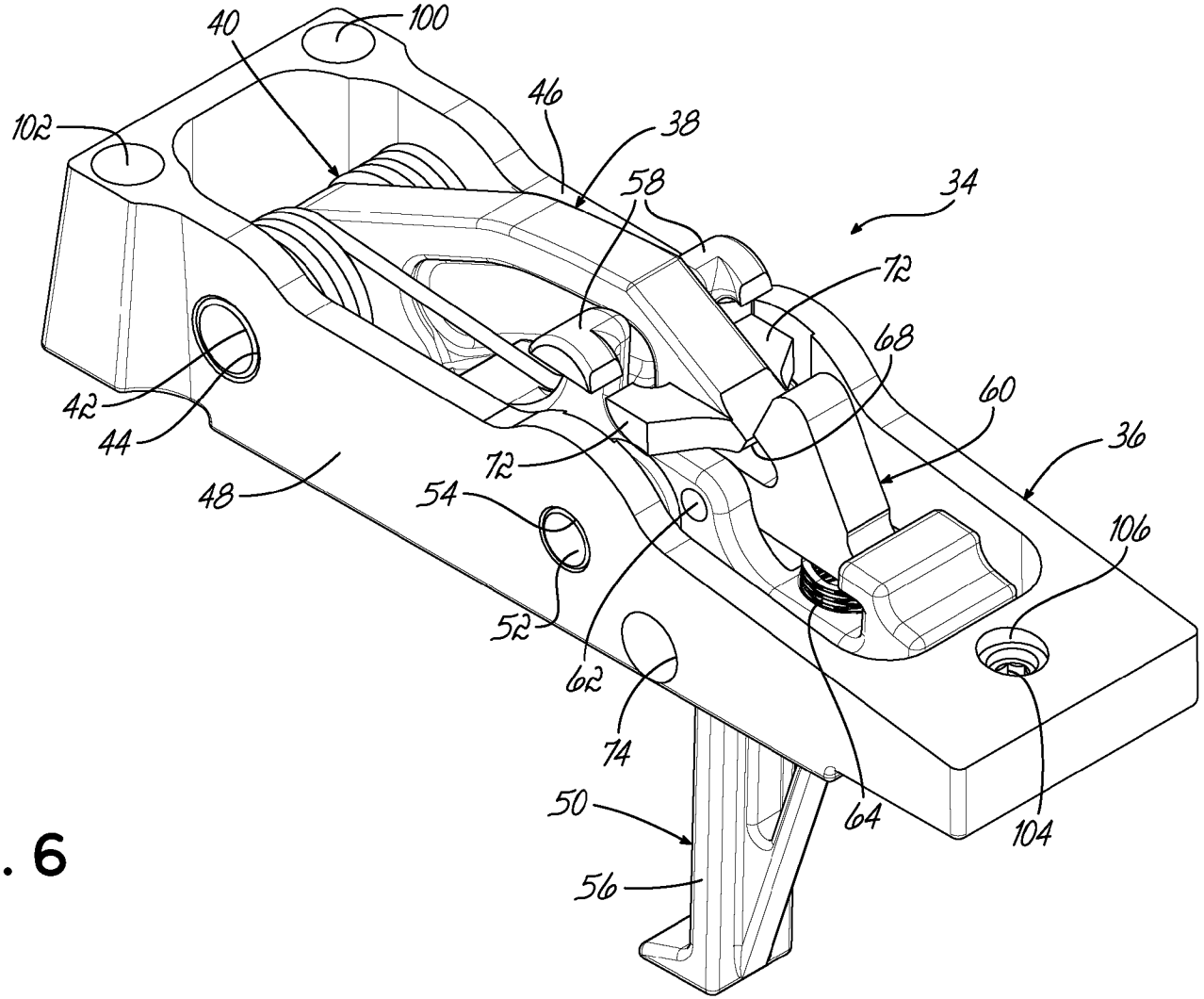
FIG. 6 is an isometric view thereof showing the hammer in a cocked or "set" position.
Figure 7:
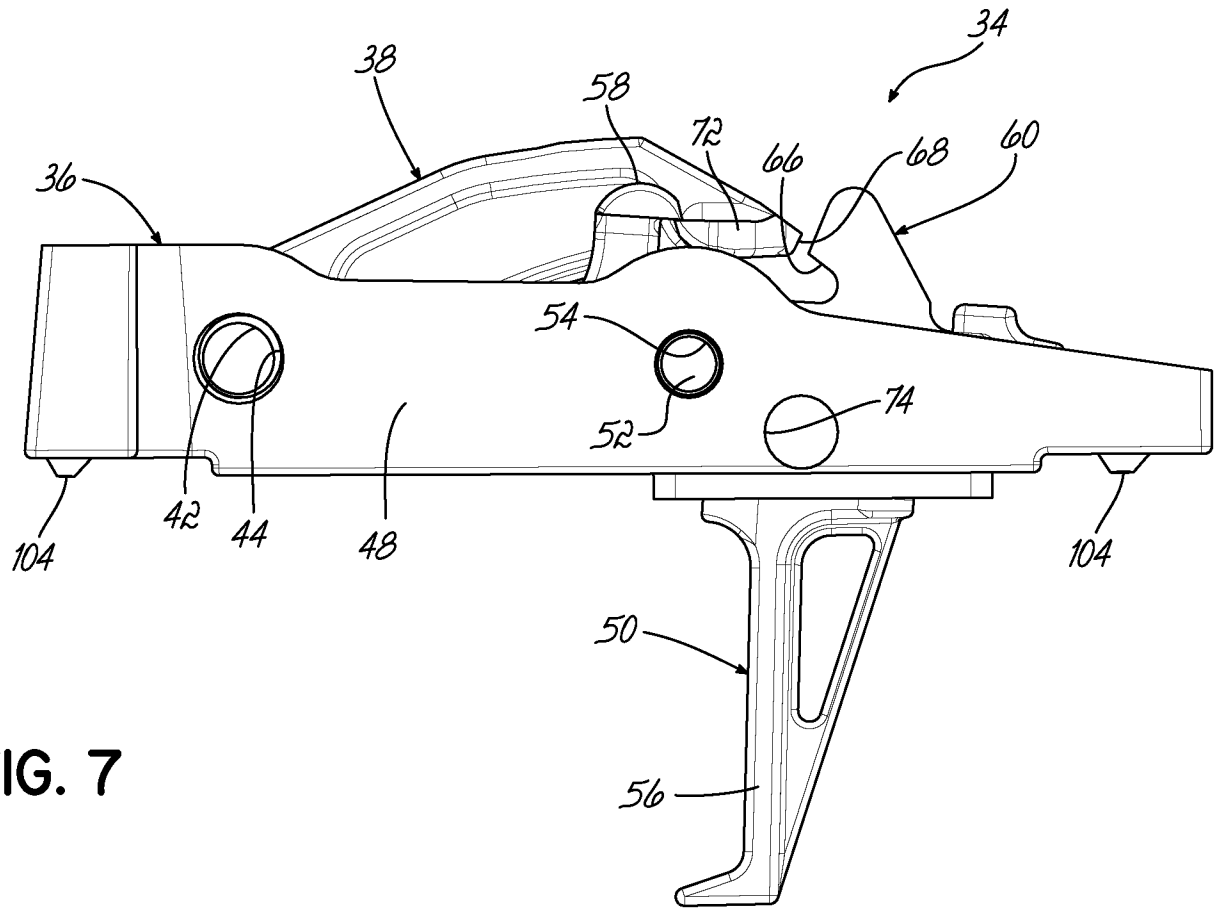
FIG. 7 is a left-side plan view thereof.

Referring specifically to FIGS. 6 and 7, when the hammer 38 is in a "set" or cocked position, it is held by either engagement of the sear hook portions 58 with sear flanges 72 or by engagement of the end edge 68 with the hook 66 of the disconnector 60. In a well-known manner, engagement of the hammer 38 by the disconnector 60 is shifted to engagement by the sear surfaces 58, 72 as the trigger member 50 is released by the user after the cycling of the firearm action when it is fired.

Referring again generally to FIGS. 2-7, the side walls 46, 48 of the frame 36 include a pair of transversely aligned mounting pin openings 74. As will be explained in greater detail later, these mounting pin openings 74 are positioned to align with the original trigger assembly pin 28 (on which an OEM trigger member 14 pivots). According to one aspect of the present invention, the trigger member 50 is mounted to pivot about a separate transverse axis spaced from and generally, but not necessarily exactly, parallel to the mounting pin opening 74.

Figure 5:
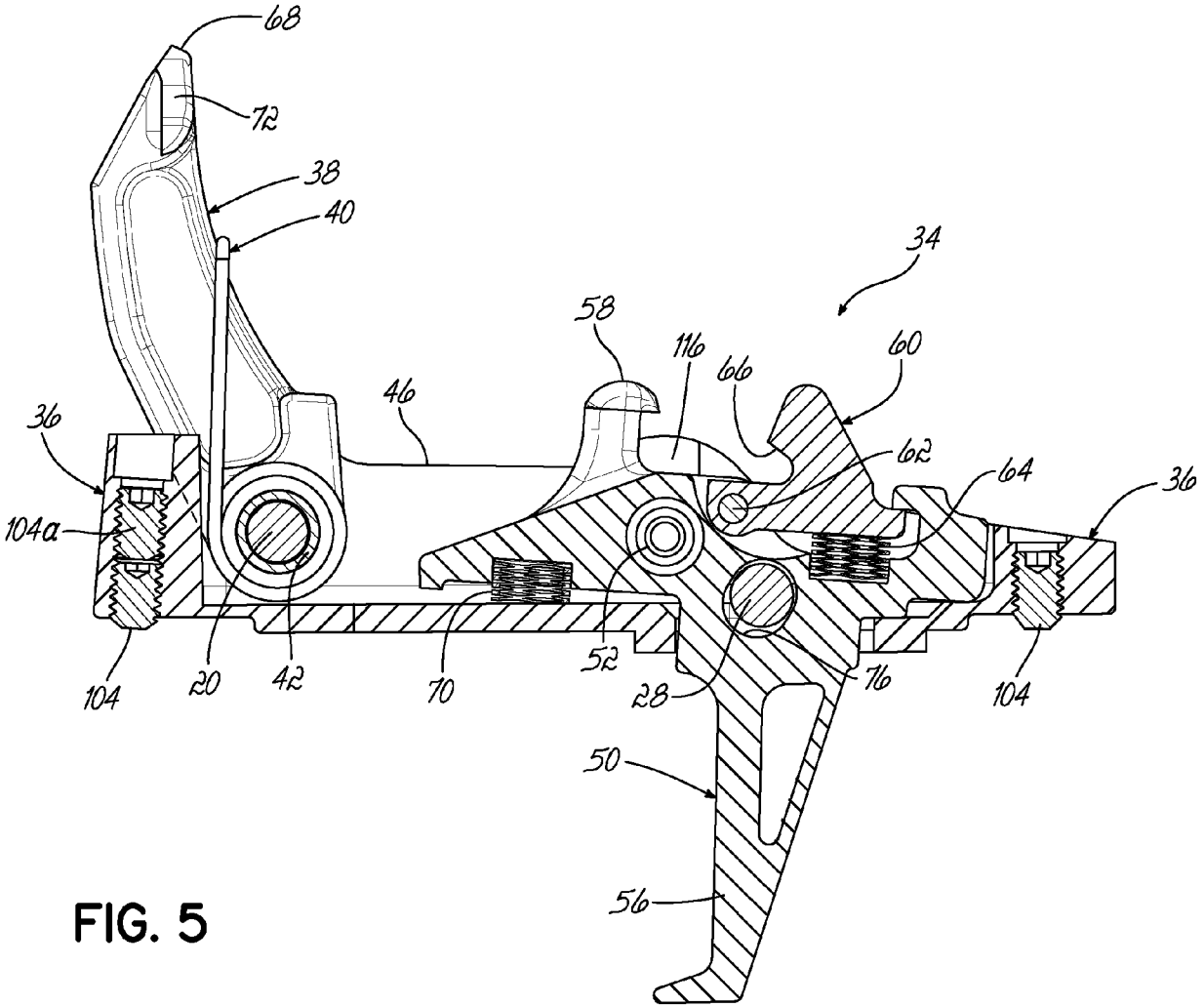
FIG. 5 is a side sectional view thereof taken generally along line 5-5 of FIG. 2.

Referring to FIG. 5, it can be seen that the trigger member 50 includes an oversized passageway 76 which allows transverse passage of the rear mounting pin 28 while allowing pivotal movement of the trigger member 50 about the offset mounting pin 52. In this manner, and as will be explained further below, the rear mounting pin 28 passes through openings 30 in the receiver 10 and mounting pin opening 74 in the frame 36 of the drop-in unit 34 to secure the unit 34 in place. The rear mounting pin 28 does not, however, act as a pivot axis for the trigger member 50. Accordingly, parallel pivot axes of the hammer 38 and trigger member 50 may be maintained in precise alignment even if the mounting pins 20, 28 are not.

Figure 8:
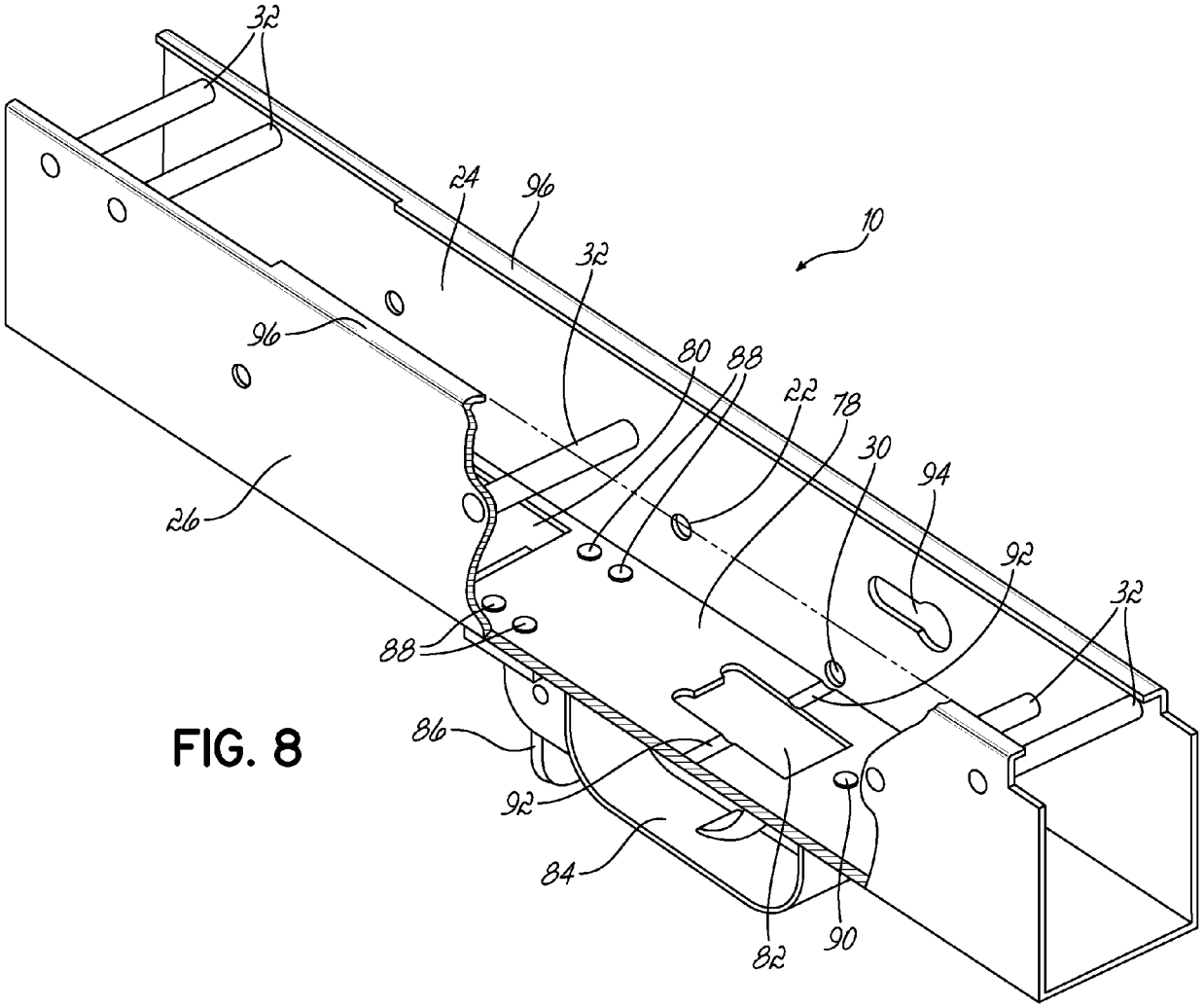
FIG. 8 is a partially cut-away isometric view of an AK-pattern receiver with a trigger guard and magazine release installed, but without a trigger mechanism.

Referring now to FIG. 8, therein is shown a receiver 10 according to a typical and representative AK-pattern firearm. The receiver 10 is identical in all pertinent respects to the receiver 10 illustrated in FIG. 1, which shows a prior art, OEM fire control system. Various openings are provided in the floor 78 of the receiver 10, including a forward opening 80 that receives an ammunition magazine (not shown) and, rearwardly therefrom, an opening 82 which allows a trigger to extend below the receiver 10. A trigger guard 84 and magazine release lever 86 may be attached to the floor 78 of the receiver 10, typically with four (4) rivets 88 at a forward position and a single rivet 90 at a rearward position. The inner surface of the floor 78 may include a transverse groove 92 aligned with the original trigger pin openings 30, because the trigger mounting pin 28 (not shown in FIG. 8) and openings 30 may be positioned extremely low in the sidewalls 24, 26, at or against the floor 78 of the receiver 10. The right sidewall 24 of the receiver 10 may include a keyhole-shaped opening for insertion of a safety member 18. Along upper edges of the sidewalls 24, 26 are inwardly extending flanges 96, which narrow the upper opening of the receiver 10 along a substantial portion of its length, including the area where the hammer and trigger mechanism of the fire control system are installed.

Figure 9:
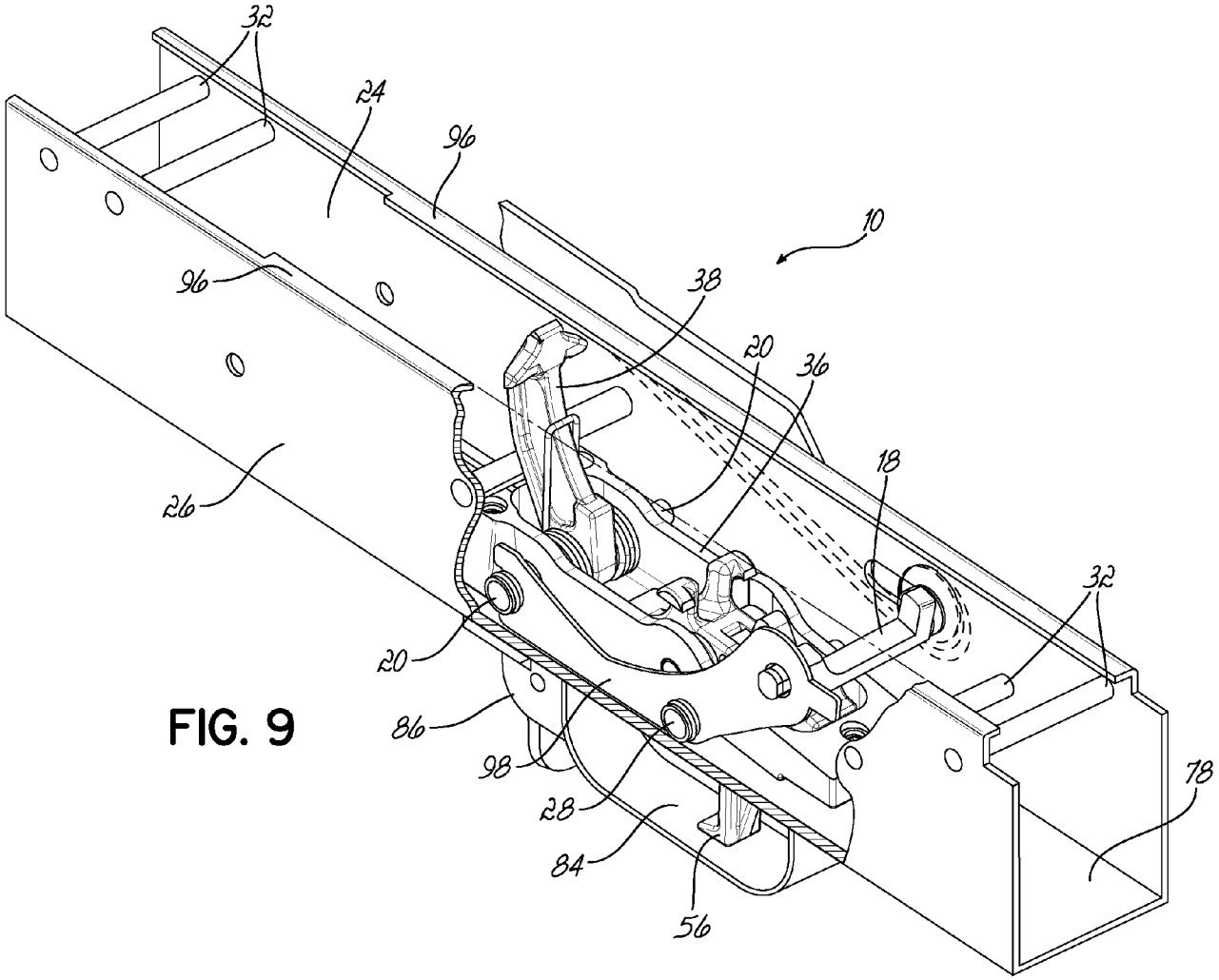
FIG. 9 is a similar view showing a replacement trigger mechanism according to an embodiment of the present invention installed therein.

With reference to FIG. 9, therein is illustrated a receiver 10 partially cut away to show a modular "drop-in" fire control unit or module 34 in an installed position in a space defined between laterally spaced apart sidewalls 24, 26. The module frame 36 is fully enclosed, both laterally and vertically, between the sidewalls 24, 26 which extend vertically at least the full height of the module frame 36. To assemble, a forward assembly pin or hammer pin 20 is inserted through opposite openings 22 in the sidewalls 24, 26 of the receiver 10 and through the axial passageway of the hammer mounting sleeve 42 that is carried by and on the frame 36. A rear assembly pin 28 (corresponding to the OEM trigger pin) is inserted through opposite openings 30 in the sidewalls 24, 26 of the receiver 10 and through the mounting pin opening 74 of the module frame 36. Notably, as described above, this assembly pin 28, which would ordinarily provide a pivot axis for a prior art trigger member, does not do so in the present invention. Instead, the trigger member 50 pivots on a separate mounting axle or pin 52, offset from the mounting pin 28. A pin retaining plate 98 of known form may be inserted within the receiver 10 after installation of the module 34 to engage annular grooves adjacent ends of the mounting pins 20, 28 to prevent axial displacement of the pins 20, 28.

Some prior art "drop-in" replacement trigger modules for the AK-pattern platform have used adjustable set screws that bear against the floor 78 of the receiver 10 in order to prevent lateral or other unintended movement of the module after installation. In these prior examples, threaded vertical openings on lateral sides of a module frame have been positioned longitudinally in between the hammer and trigger axes of rotation, which are provided by the mounting pins 20, 28 in those examples. Set screws within these threaded openings are adjusted to extend below the frame of the module and bear against the floor 78 of the receiver 10. In some cases, over-tensioning or extension of the set screws have been known to deform the floor 78 of the receiver 10, leading to an unsightly appearance and/or other undesirable consequences.

According to another aspect of the present invention, adjustable securement means may be provided at forward and rearward locations on the frame 36. These may be positioned longitudinally forward of the hammer 38 axis of rotation and/or rearward of the trigger 50 axis of rotation and assembly pin 28. For example, as shown in FIGS. 2-5, internally threaded forward sockets 100, 102 that are laterally spaced apart may be provided at or near a forward end portion of the frame 36. Threaded set screws 104 may be engaged in the openings 100, 102 to extend below a bottom edge of the frame 36 and may be adjusted from above through the openings 100, 102. If desired, the threaded sockets 100, 102 may extend at slightly forward and/or outwardly diverging angles, as shown. Also if desired, the set screws 104 may be selected to have a sufficiently short length that a second set screw **104*a* may be threaded into the socket 100, 102 after the first, providing thread tension between the associated set screws to lock them against unintended rotation. Another internally threaded socket 106 may be provided at or near a rear portion of the frame 36 to receive an adjustable set screw 104. This may be at a location longitudinally aft of the mounting pin opening 74 that receives mounting pin 28 and/or aft of the mounting pin 52 axis for the trigger member 50**.

As can be observed from a comparison of FIGS. 8 and 9, the forward sockets 100, 102 and set screws 104 may be positioned to align with and bear against inside heads of the rivets 88 that secure the forward end of the trigger guard 84 and magazine release 86 to the floor 78 of the receiver 10, rather than against the material of the floor panel 78 itself. Likewise, the rear socket 106 and set screw 104 may be positioned to bear against a rivet 90 which secures the trigger guard 84 at its rear end. In this manner, the unevenness that may be created by the varied heights of the assembly rivets 88, 90 may be compensated for and dimpling or distortion of the floor panel 78 can be avoided. Additionally, the three points of contact provide a greater degree of exact aligning adjustment for the module 34.

Figure 10:
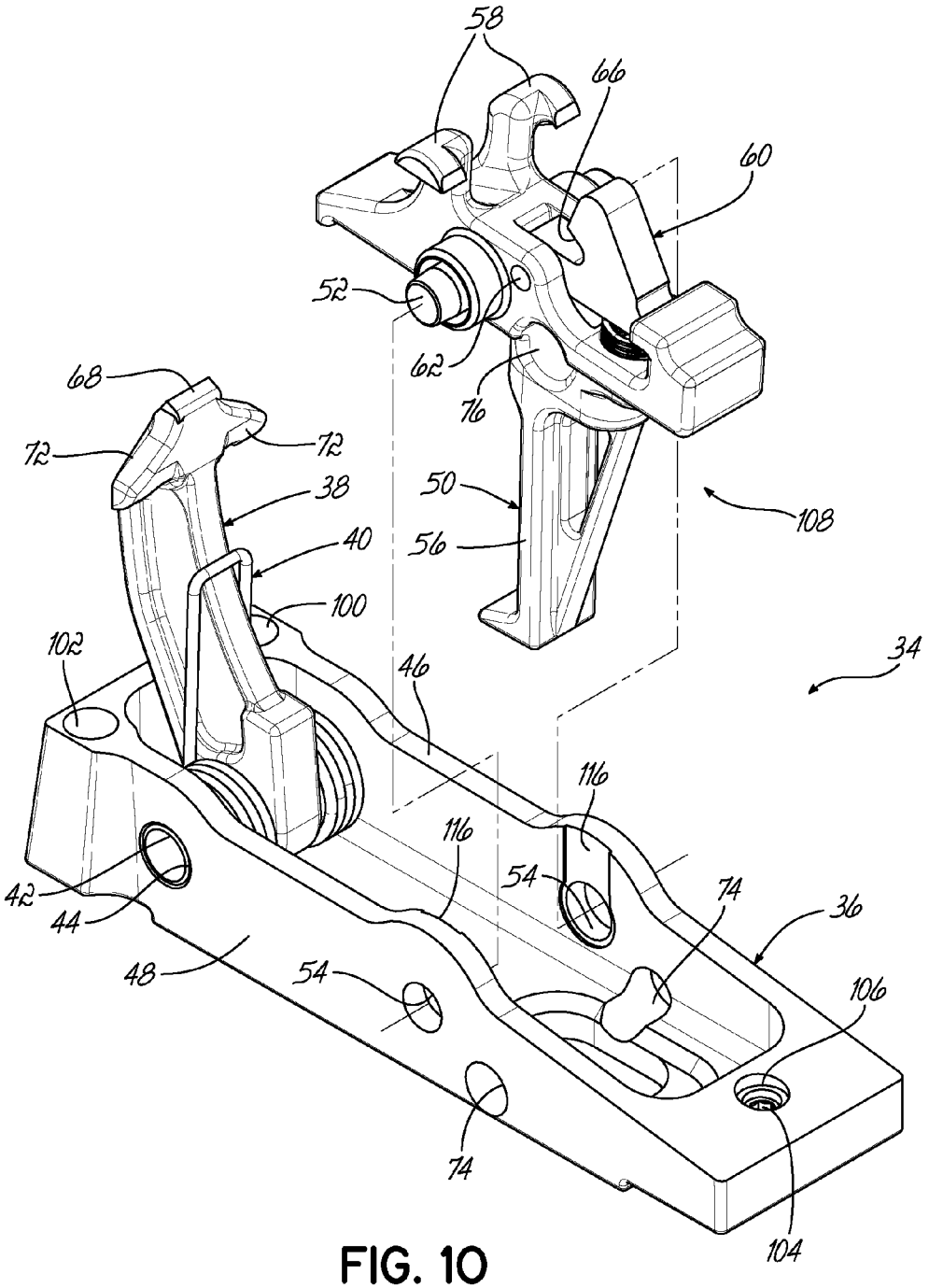
FIG. 10 is a partially exploded isometric view similar to FIG. 2 in which the trigger member and disconnector unit is separated from the frame or housing.
Figure 11:
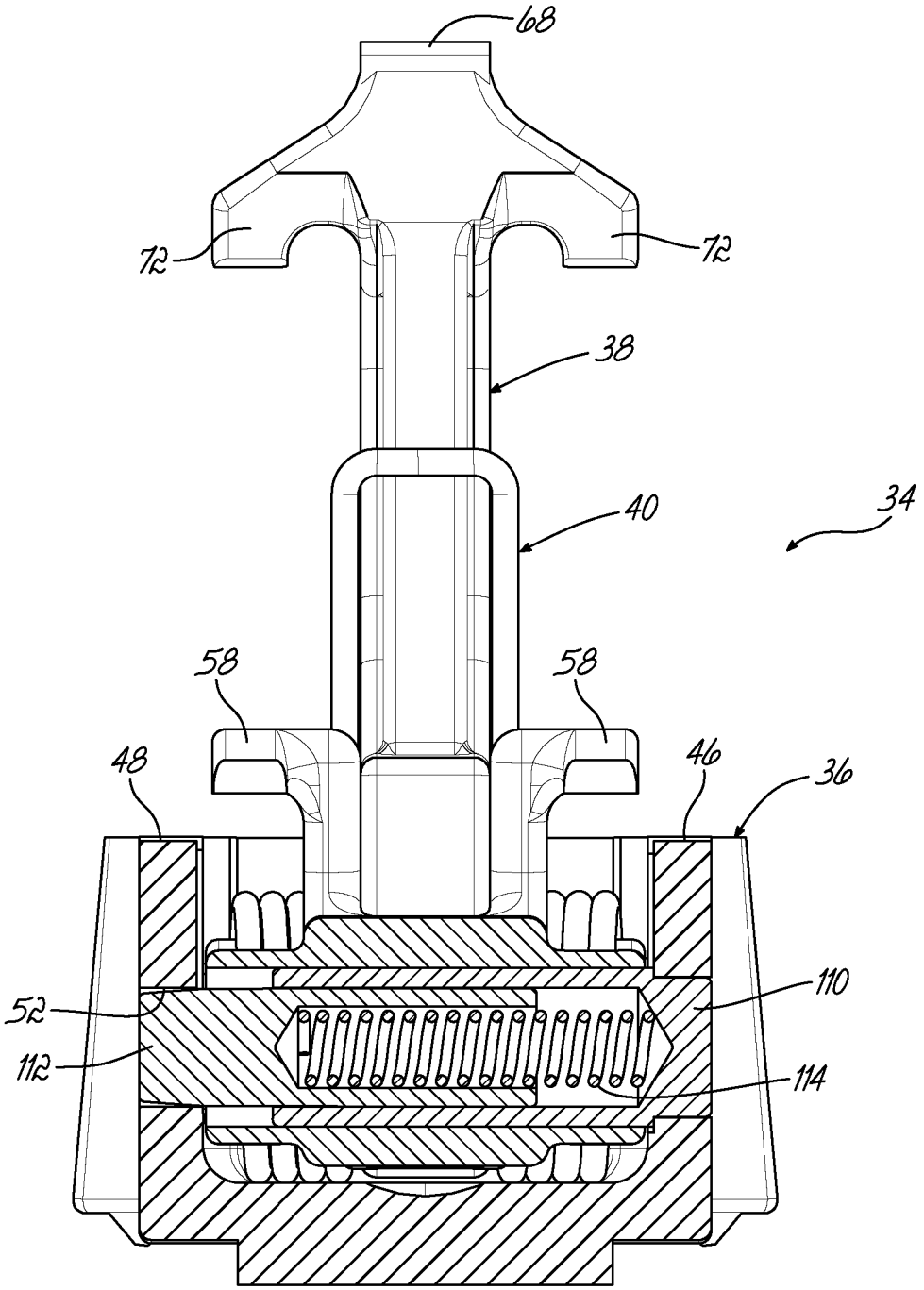
FIG. 11 is a rear sectional view taken substantially along line 11-11 of FIG. 2 showing the releasable trigger member pivot pin mechanism.

Referring now also to FIGS. 10 and 11, according to another aspect of the present invention and novel installation method, the replacement module 34 may include a trigger subassembly 108 that is separable as a unit from the frame 36. Because the upper flanges 96 of the AK-pattern receiver 10 create a narrowed upper opening, insertion of the replacement module 34 without complete disassembly of the firearm may not be possible when the module 34 is fully assembled. When a barrel and stock (not shown) are assembled on the receiver 10, top access can be restricted between the flanges 96 and ends of the receiver 10 are closed off. In order to allow easy insertion, the trigger subassembly 108 is separable, allowing the frame 36 and hammer 38 assembly to be inserted first, followed by installation of the trigger subassembly 108.

As best depicted in FIG. 11, an inwardly depressible and spring-loaded mounting pin mechanism 52 may be constructed from first and second telescoping members 110, 112 outwardly biased by an internal spring 114 in opposite axial directions. Accordingly, the members 110, 112 may be squeezed together, such as with a tool, to disengage them from openings 74 in the frame 36 and allow the trigger subassembly 108 to be upwardly released and removed from the frame 36. Reinstallation of the trigger subassembly 108 is easily accomplished by squeezing together the mounting pin members 110, 112, such as with fingers or a tool, and sliding it into place along vertical inner guide channels 116 that are aligned with the trigger-mounting openings 54 in the frame 36.

As previously described, the trigger member 50 of the illustrated embodiment may include an enlarged passageway 76 positioned to allow movement of the trigger member 50 when a mounting pin 28 is inserted through the mounting pin opening 74 of the frame 36 and enlarged passageway 76. In this embodiment, the trigger sub assembly must be reinstalled on the frame 36 before insertion of the rear assembly pin 28. If desired, however, the trigger member 50 could be formed with an open bottom slot (not shown), instead of the enlarged passageway 76, to allow removal and reinstallation of the trigger sub assembly 108 after the frame 36 has been secured to the receiver 10 with the rear assembly pin 28.

Accordingly, the present invention provides a replacement fire control system module and/or method of assembly for a firearm in which at least one of the original assembly pins that act as a pivot access for the hammer and trigger is used only to secure the module frame 36 to the receiver 10 and not as a pivot axis for moving parts of the replacement module. This construction allows the pivot axes of the hammer and trigger to be maintained precisely parallel to each other when the module is installed, even if the mounting holes for the hammer and trigger pins in the receiver are not precisely aligned.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims. Unless expressly specified, steps of a method disclosed or claimed herein may be performed in a different sequence and/or some steps may be performed simultaneously.

What is claimed is:

1. A trigger group module for a firearm, the firearm including a portion defining a trigger group receiving area defined between laterally spaced apart walls, each of the walls having top edges and at least two openings for receiving assembly pins, each of the at least two openings being laterally aligned with an opening in an opposite wall to form at least first and second aligned pairs of assembly pin receiving openings, the trigger group module comprising:

a module frame sized to be inserted into the trigger group receiving area such that the laterally spaced apart walls extend over a full height of the module frame, the frame having assembly pin receiving openings, each of the frame's assembly pin openings positioned to align with one of the first and second pairs of laterally aligned openings in the walls of the trigger group receiving area;

a hammer member pivotally supported by the module frame along a first substantially laterally extending axis; and a trigger member supported by the module frame along a second substantially laterally extending axis, wherein at least one of the first and second substantially laterally extending axes is not coaxially aligned with one of the first and second aligned pairs of assembly pin receiving openings.

2. The trigger group module of claim 1, wherein the laterally extending axis of the hammer member is coaxially aligned with one aligned pair of assembly pin openings and the laterally extending axis of the trigger member is not axially aligned with one of the first and second aligned pairs of assembly pin openings.

3. The trigger group module of claim 1, wherein the module frame has side walls and the assembly pin receiving openings are in the frame side walls.

4. The trigger group module of claim 1, wherein the frame includes at least two internally threaded set screw sockets with a set screw in each oriented to be extensible toward and contact a bottom surface in the trigger group receiving area of the firearm receiver.

5. The trigger group module of claim 4, wherein the set screw sockets are laterally spaced apart from one another.

6. The trigger group module of claim 5, wherein the set screw sockets are inclined relative to vertical.

7. The trigger group module of claim 4, wherein the set screw sockets are longitudinally spaced apart from one another.

8. The trigger group module of claim 4, wherein at least one of the set screw sockets is positioned forward of the hammer member laterally extending axis.

9. The trigger group module of claim 4, wherein at least one of the set screw sockets is positioned rearward of the trigger member laterally extending axis.

10. The trigger group module of claim 8, wherein at least one of the set screw sockets is positioned rearward of the trigger member laterally extending axis.

11. The trigger group module of claim 4, wherein at least one of the set screw sockets includes more than one axially aligned set screws.

12. The trigger group module of claim 1, wherein the trigger member includes a passageway for receiving an assembly pin not coaxially aligned with the laterally extending axis of the trigger member, the passageway being enlarged to allow pivotal motion of the trigger member relative to and independent of the assembly pin.

13. The trigger group module of claim 3, wherein the trigger member includes a spring-loaded pivot mounting assembly configured to allow removal of the trigger member from the frame without axial displacement outside the side walls of the frame.

14. The trigger group module of claim 13, further comprising upwardly oriented guide channels on interior surfaces of the side walls of the frame to receive portions of the spring-loaded mounting assembly during removal and assembly of the trigger member with the frame.

15. In combination:

a firearm receiver including a portion defining a trigger group receiving area defined between laterally spaced apart walls, each of the walls having at least two openings for receiving assembly pins, each of the at least two openings being laterally aligned with an opening in an opposite wall to form at least first and second aligned pairs of assembly pin openings;

a module frame sized to be inserted into the trigger group receiving area and having assembly pin receiving openings, each of the frame's assembly pin openings positioned to align with one of the first and second pairs of laterally aligned openings in the walls of the trigger group receiving area;

a hammer member pivotally supported by the module frame along a first substantially laterally extending axis; and a trigger member supported by the module frame along a second substantially laterally extending axis, wherein at least one of the first and second substantially laterally extending axes is not coaxially aligned with one of the first and second aligned pairs of assembly pin receiving openings, and wherein the laterally spaced apart walls of the receiver extend over a full height of the module frame.

16. The combination of claim 15, wherein the laterally extending axis of the hammer member is coaxially aligned with one of the first and second aligned pairs of assembly pin openings and the laterally extending axis of the trigger member is not axially aligned with another of the first and second aligned pairs of assembly pin openings.

17. The combination of claim 15, wherein the module frame has side walls and the assembly pin receiving openings are in the frame side walls.

18. The combination of claim 15, wherein the frame includes at least two internally threaded set screw sockets with a set screw in each oriented to be extensible toward contact with a bottom surface in the trigger group receiving area of the firearm receiver.

19. The combination of claim 18, wherein the set screw sockets are laterally spaced apart from one another.

20. The combination of claim 19, wherein the set screw sockets are inclined relative to vertical.

21. The combination of claim 18, wherein the set screw sockets are longitudinally spaced apart from one another.

22. The combination of claim 18, wherein at least one of the set screw sockets is positioned forward of the hammer member laterally extending axis.

23. The combination of claim 18, wherein at least one of the set screw sockets is positioned rearward of the trigger member laterally extending axis.

24. The combination of claim 22, wherein at least one of the set screw sockets is positioned rearward of the trigger member laterally extending axis.

25. The combination of claim 18, wherein at least one of the set screw sockets includes more than one axially aligned set screws.

26. The combination of claim 15, wherein the trigger member includes a passageway for receiving an assembly pin not coaxially aligned with the laterally extending axis of the trigger member, the passageway being oversized to allow pivotal motion of trigger member relative to and independent of the assembly pin.

27. The combination of claim 17, wherein the trigger member includes a spring-loaded pivot mounting assembly configured to allow removal of the trigger member from the frame without axial displacement outside the side walls of the frame.

28. The combination of claim 27, further comprising upwardly oriented guide channels on interior surfaces of the side walls of the frame to receive portions of the spring-loaded mounting assembly during removal and assembly of the trigger member with the frame.

* * * * *